US006826803B2

(12) United States Patent
Twomey

(10) Patent No.: US 6,826,803 B2
(45) Date of Patent: Dec. 7, 2004

(54) TOILET SEAT HINGE AND METHOD OF USE

(75) Inventor: Michael R Twomey, Newnan, GA (US)

(73) Assignee: Olsonite Corporation, Newnan, GA (US)

( * ) Notice: Subject to any disclaimer, the term of this patent is extended or adjusted under 35 U.S.C. 154(b) by 0 days.

(21) Appl. No.: 10/323,635

(22) Filed: Dec. 20, 2002

(65) Prior Publication Data

US 2003/0145429 A1 Aug. 7, 2003

Related U.S. Application Data

(60) Provisional application No. 60/353,228, filed on Feb. 4, 2002.

(51) Int. Cl.[7] ..... E05D 5/02

(52) U.S. Cl. ..... 16/387; 16/389; 16/225

(58) Field of Search ..... 16/387, 365, 389, 16/390–392, 225; 4/236, 240, 234; D8/323, 326

(56) References Cited

U.S. PATENT DOCUMENTS

| | | | | | |
|---|---|---|---|---|---|
| 3,665,552 | A | | 5/1972 | Toldo et al. | |
| 4,173,802 | A | * | 11/1979 | Wikstrom | 4/236 |
| 4,314,382 | A | * | 2/1982 | Ginsburg et al. | 4/236 |
| 4,315,338 | A | * | 2/1982 | Harrison | 4/236 |
| 4,391,001 | A | * | 7/1983 | Harrison | 4/236 |
| 4,398,307 | A | | 8/1983 | Ginsburg et al. | |
| 4,467,481 | A | * | 8/1984 | Ginsburg | 4/240 |
| 4,974,262 | A | * | 12/1990 | Rosen | 4/236 |
| 5,448,781 | A | * | 9/1995 | Miller | 4/235 |
| D370,252 | S | * | 5/1996 | Hulsebus | D8/326 |
| 5,918,322 | A | * | 7/1999 | Yamamoto et al. | 4/248 |
| 6,006,370 | A | * | 12/1999 | Wu | 4/244.3 |
| 6,453,478 | B1 | * | 9/2002 | Semmler | 4/236 |
| 6,658,672 | B2 | * | 12/2003 | Hsieh | 4/236 |

FOREIGN PATENT DOCUMENTS

| | | | | |
|---|---|---|---|---|
| DE | 3248028 A1 | * | 6/1984 | A47K/13/12 |
| FR | 2590470 A1 | * | 5/1987 | A47K/13/12 |
| GB | 2364743 A | * | 2/2002 | A47K/13/12 |

* cited by examiner

*Primary Examiner*—Chuck Y. Mah
(74) *Attorney, Agent, or Firm*—Clark & Brody

(57) ABSTRACT

A toilet seat hinge and base assembly to retain toilet seats on a toilet bowl uses a pair of hinge bases and a pair of hinge leafs for each base. The base is adapted to be secured to a toilet bowl, with the leaf hinges securing the toilet seat ring and toilet seat cover to the hinge bases. Each leaf has the same shape and can be used to secure either the ring or the ring cover to the hinge base thereby simplifying installation or replacement procedures. The hinge base can also be used with molded seat covers and rings that include attachment tabs. The tabs interface with the hinge bases to form the seat assembly.

7 Claims, 3 Drawing Sheets

30'
31
33
30
31
10

30'
30
31
33
35

39
41
30
31
35
33

TOILET SEAT HINGE AND METHOD OF USE

This patent is based on provisional patent application No. 60/353,228 filed on Feb. 4, 2002.

FIELD OF THE INVENTION

The present invention is directed to a toilet seat hinge, and in particular to a hinge that employs symmetrical hinge leafs and a double post hinge base for ease of manufacturing and use.

BACKGROUND ART

In the prior art, various toilet seat hinges have been proposed as shown in U.S. Pat. Nos. 4,314,382 and 4,398,307, to Ginsburg et al., U.S. Pat. No. 4,974,262 to Rosen, U.S. Pat. No. 4,391,001 to Harrison, U.S. Pat. No. 3,665,552 to Toldo.

However, many of these hinges are not versatile and are complicated to manufacture. Further, many prior art designs are conducive to hinge loosening due to relative movement between the toilet seat ring and seat cover. Consequently, there exists a need for improved toilet seat hinges. The present invention solves this need by providing a toilet seat hinge that uses a base that is adapted for both molded plastic seat rings and covers and seat rings and covers requiring leafs, and better secures both types of seat assemblies in place.

SUMMARY OF THE INVENTION

It is a first object of the present invention to provide an improved toilet seat assembly that employs a unique hinge base.

Another object of the invention is to provide a toilet seat hinge assembly that employs symmetrical leafs, particularly in combination with the inventive hinge base.

Still another object of the invention is a toilet seat hinge base that can be used with molded plastic seats as well as wooden and soft touch seats.

One further object of the invention is a method of using the hinge base with either symmetrical leafs or molded seat components that interface with the hinge to form the seat assembly Other objects and advantages of the present invention will become apparent as a description thereof proceeds.

In satisfaction of the foregoing objects and advantages, one aspect of the present invention is an improvement in toilet seat hinges that employs a hinge base and a pair of hinge leafs for toilet seat attachment. According to this aspect, each leaf is made with essentially the same shape so that the leafs can be used interchangeably for attaching a toilet seat ring and cover to the base.

Each leaf has an attachment portion adapted for connecting to either the seat ring or the seat cover, and a pivot arm for connecting to the hinge base. The attachment portion can have one or more openings for connection to the seat ring or cover. Each pivot arm also has an opening to link with the hinge base. One preferred shape of the attachment portion is a trapezoidal one.

The hinge base has a pair of upstanding posts, each with a through opening at an end thereof. The through opening is sized to receive a connecting pin which extends through the through openings in the posts of the hinge base, and an opening in the pivot arm of each leaf.

The invention also includes a toilet seat assembly that comprises a pair of hinge assemblies, a toilet seat cover, and a toilet seat ring. The attachment portions of the leafs are secured to the seat ring and seat cover, and the pivot arms of each pair of leafs are positioned between the posts of respective hinge bases to form the assembly.

In another aspect of the invention, the hinge base can be employed with seat rings and seat covers that come molded with attachment tabs. The attachment tabs take the place of the pivot arms of the leafs such that the seat cover and seat ring can directly link to the hinge base to form the toilet seat assembly.

In yet another aspect of the invention, a method of using the hinge base is disclosed, wherein the hinge base is linked to the tabs of a seat ring and seat cover to form a toilet seat assembly using a connecting pin with each hinge base. Alternatively, each hinge base can link to a pair of leafs using a connection pin, wherein the leafs are attached to a seat cover and seat lid to form the seat assembly.

DESCRIPTION OF THE PREFERRED EMBODIMENTS

The invention provides significant improvements in the field of toilet seat hinges. First, the hinge base provides a structure that can be used on either the left side or the right side of a toilet, whether the seat is molded plastic or wood, or is a "soft touch" seat assembly.

Second, the symmetrical leafs combine with the hinge base for effective connection to wooden seats or soft seat assemblies. With the symmetrical leafs, only one leaf has to be made, and manufacturing costs are significantly reduced.

Another advantage of the hinge and leaf design is that the cover and seat movement is restrained. This restraint results in far less occurrences of hinge loosening on the ceramic. More particularly, the double post design of the hinge keeps the tabs of a molded seat ring and cover adjacent to each other. This design prevents the seat ring and cover from moving with respect to each other. Likewise, when the symmetrical leafs are employed, their pivot arms are adjacent to each other so that lateral movement is reduced or eliminated.

Figure 2:
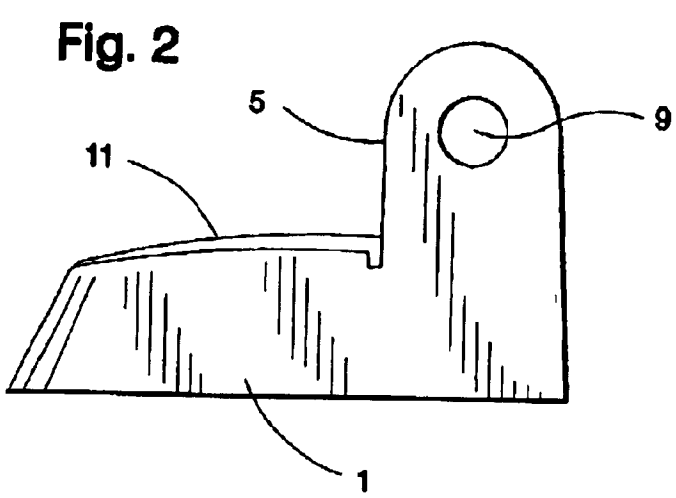
FIG. 2 shows a side view of the hinge base of FIG. 1.
Figure 1:
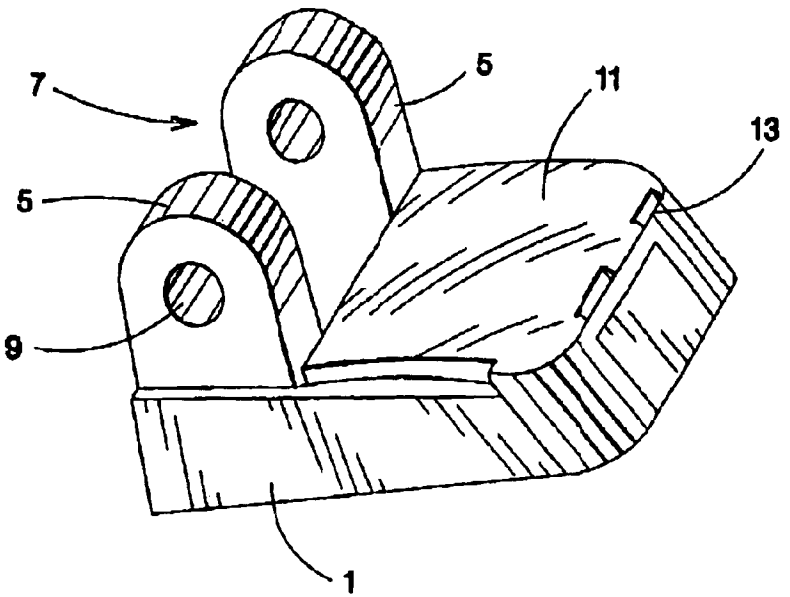
FIG. 1 shows a perspective view of the hinge base of the invention.
Figure 3:
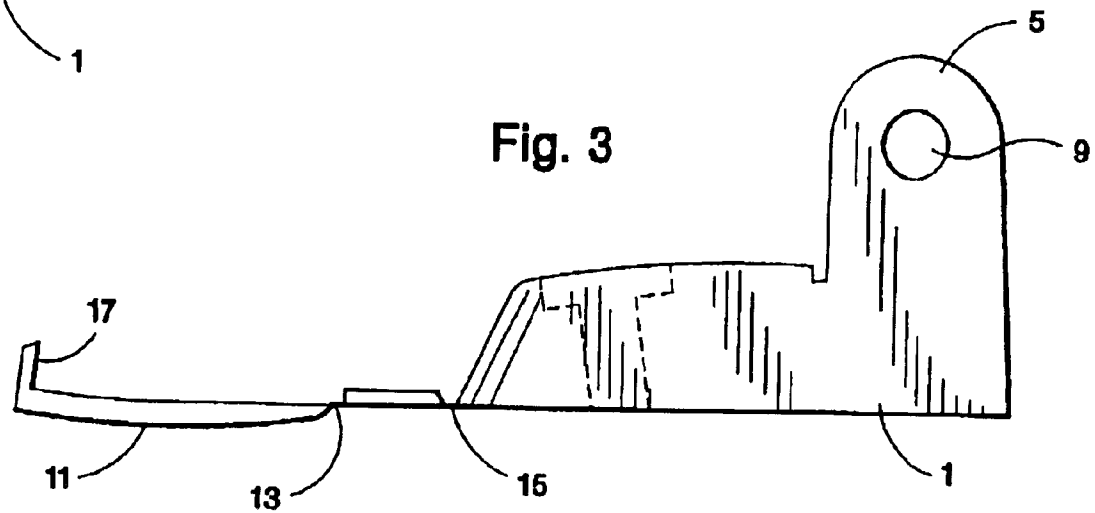
FIG. 3 shows a side view of the hinge base of FIG. 1 with the lid opened.

Referring to FIGS. 1–3, one example of a hinge base is designated by the reference numeral 10 and includes a base portion 1, and a pair of upright posts 5 that form a yoke with a space 7 therebetween. Each post 5 has a through opening 9 which is designed to receive a pin for securing either a molded seat to the hinge base or a pair of leafs.

The base 10 also has a bolt cover 11 as best seen in FIG. 3. The bolt cover 11 has a first hinge junction 13, and a second hinge junction 15 to allow for cover movement between open and closed positions. The bolt cover 11 also has an end flange 17, which fits within the opening 19. The bolt cover 11 covers the recess and opening in the hinge base portion that receives a head of the toilet seat bolt and allows the bolt to pass through the base, extend through the ceramic of the toilet and engage a nut for attachment purposes.

Figure 8:
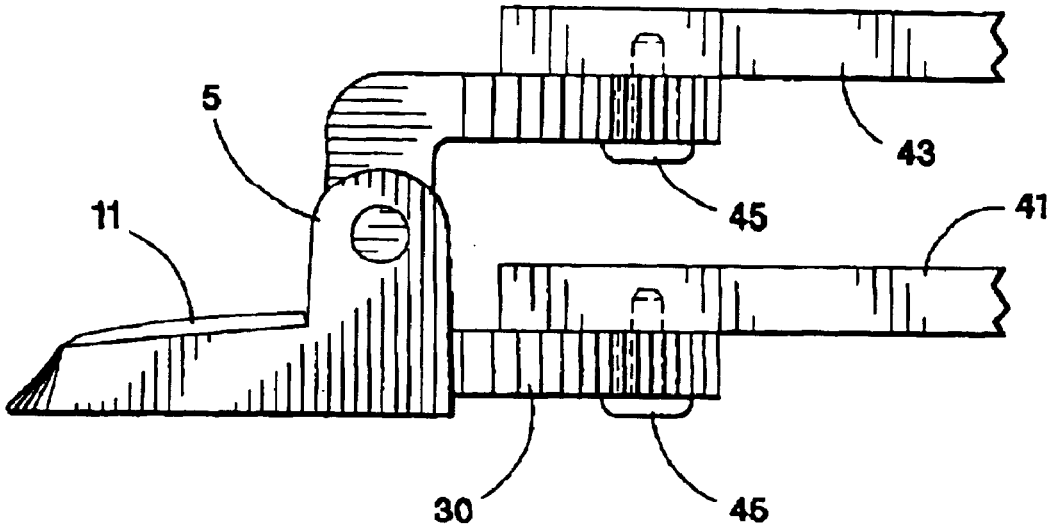
FIG. 8 shows a side view of the hinge assembly in combination with a wooden or soft covered seat.

In one use, the hinge base 10 can be used with molded plastic seat rings and covers. Referring now to FIG. 8, the hinge base is shown connected to a seat ring tab 21 and a cover tab 23, each tab having a through opening 24. For clarity purposes, the actual seat ring and cover are not shown. These are the tabs that are conventionally formed on molded plastic seats. In prior art designs with single post hinge bases, the tabs are positioned on the outside surfaces of the post. This prior art arrangement allows the seat ring and cover to shift since one side of the tab is exposed. This shifting can loosen the toilet seat bolt and require retightening.

With the inventive hinge base, the seat ring tab 21 and the cover tab 23 are positioned in the space 7 between the posts 5 so that they are adjacent each other. In this way, each tab is faced with a stationary surface, e.g., the post inside face 25 and a face 27 of the adjacent tab 23. A stainless pin 29 is used to secure the tabs 21 and 23 in place so that the seat ring and cover can rotate about an axis of the pin 29.

Figures 4, 5, 6:
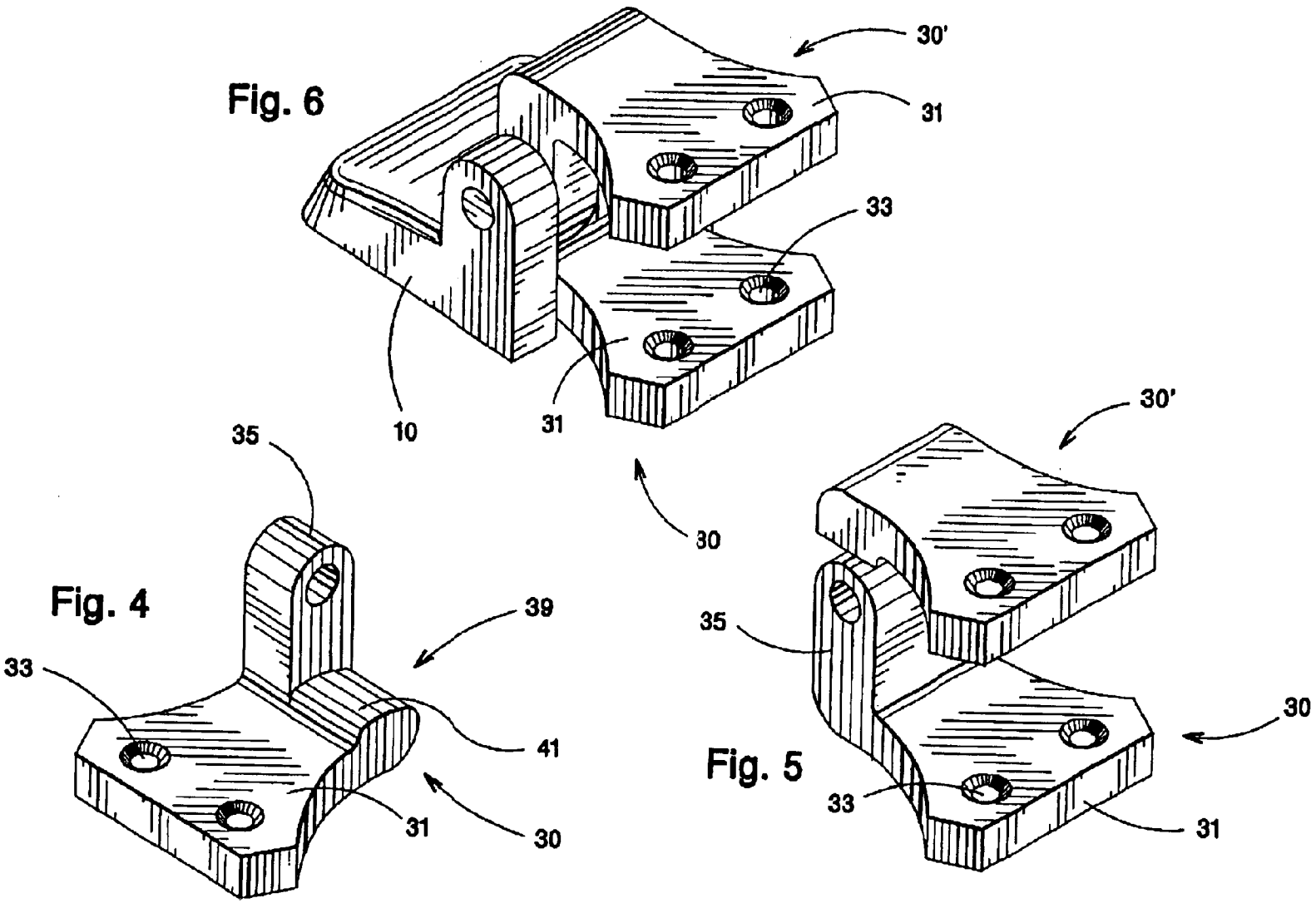
FIG. 4 shows a perspective view of a single leaf of the toilet seat hinge.
FIG. 5 shows a perspective view of pair of leafs in a stacked relationship.
FIG. 6 shows the pair of leafs in combination with the hinge base.

The hinge base 10 can also be used with a pair of symmetrical leafs 30 and 30' as shown in FIGS. 4–6. One leaf 30 is shown in FIG. 4 with an attachment portion 31 and a pair of openings 33 therethrough (one opening in each portion 33 could be used.) The openings 33 allow the attachment portion to be secured to a seat ring or cover using fasteners (see FIG. 8) or the like. Although a pair of openings and fasteners are disclosed, any other type of attachment means can be used to attach the portions to the seat ring of cover of a toilet seat assembly.

The leaf also has a pivot arm 35 that extends from the attachment portion 31 so that the leaf has an L-shape. The pivot arm 35 has an opening 37 which functions in a similar fashion as the openings 24 in the tabs of FIG. 7, i.e., allowing the leaf to pivot about the axis of the pin 29 when connected between the hinge base 10 and a seat cover or seat ring.

The design of the leaf 30 itself is asymmetrical in that the pivot arm 35 extends only half way across the width of the attachment portion 31 at the end 39, thus forming a flat 41. In this way, two leafs 30 can be stacked as shown in FIG. 5, with the pivot arm 35 of each leaf being adjacent to each other just as the tabs 21 and 23 are in FIG. 7. With the inventive leaf configuration, only one leaf shape is needed to secure the seat ring and cover for each hinge base. In addition, the hinge base 10 can be used on either side of the toilet seat assembly, so that only two parts need to be made to form the hinge construction for seat rings and covers that require leaf attachment.

For molded components, there is no need for leafs, but the same hinge base can be used for both bolt attachment points. In this regard, the tabs 21 and 23 of FIG. 8 could be part of the molded seat and seat cover rather than parts of the leafs.

Figure 7:
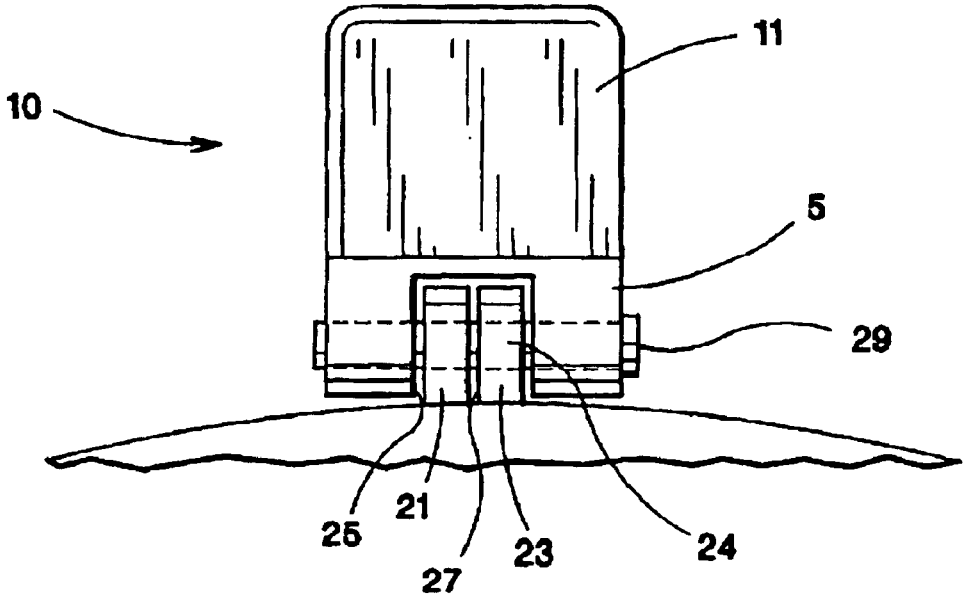
FIG. 7 shows a schematic view of the hinge in combination with a molded seat assembly.

While the leafs are shown with a trapezoidal attachment portion 31, other shapes can be utilized as would be within the skill of the art. Similarly, other hinge base shapes could be employed providing that the pair of upstanding posts remains so that the effect shown in FIG. 7 is maintained.

FIG. 8 shows a side view of the assembly of FIG. 6 with a seat ring 41 attached to lower leaf 30 and a cover 43 attached to the upper leaf 30'. Fasteners 45, e.g., screws or the like, are employed to secure the leafs to the seat cover and seat ring.

While the hinge base and leaf can be made of any materials, it is preferred that they are made from non-metallic materials such as polymers. The method of making the components can vary as well, and can include all known fabricating methods, including molding of polymeric compounds and materials.

As such, an invention has been disclosed in terms of preferred embodiments thereof which fulfills each and every one of the objects of the present invention as set forth above and provides a new and improved toilet seat hinge, components thereof, and a toilet seat assembly.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In a toilet seat hinge having a pair of hinge bases and a pair of hinge leafs for each base, the improvement comprising each leaf having essentially the same shape so that each leaf can be used to attach to toilet seat ring or toilet seat cover; each of said leafs further comprising:

a plate-like attachment portion having spaced apart through openings for connecting to a toilet seat cover or lid on one end and a raised portion having a generally flat surface at an end opposite the one end, and a single pivot arm portion having a through opening and extending at a right angle from the plate-like attachment portion and being adjacent the raised portion.

2. The hinge of claim 1, wherein each base has a pair of upstanding posts, with the single pivoting arms of each pair of hinge leafs positioned between the upstanding posts of the base and held in place by a steel pin engaging aligned openings in the pair of upstanding costs and single pivoting arm.

3. The hinge of claim 1, wherein the plate-like attachment portion is trapezoidal in shape, with the wider end of the trapezoid corresponding to the one end.

4. A toilet seat assembly comprising:

a seat ring;

a seat cover;

a pair of hinge bases, each hinge base having a base portion and a pair of upstanding posts with a through opening in each post and a space between each post;

first and second pairs of hinge leafs, all leafs having essentially the same shape, each leaf further comprising:

a plate-like attachment portion having spaced apart through openings for connecting to a toilet seat cover or lid on one end and a raised portion having a generally flat surface at an end opposite the one end, and a single pivot arm portion having a through opening and extending at a right angle from the plate-like attachment portion and being adjacent the raised portion, wherein the pivot arm portions of the first pair are positioned between the upstanding posts of one hinge base with a connecting pin, and the attachment portions of the first pair are connected to the seat cover and seat ring, respectively, and the pivot arm portions of the second pair are positioned between the upstanding posts of the other hinge base with another connecting pin, and the attachment portions of the second pair are connected to the seat cover and seat ring, respectively.

5. The toilet seat assembly of claim 4, further comprising a pair of bolts and nuts for securing the hinge base to a toilet.

6. A method of using a hinge base in a toilet seat assembly comprising:

providing a pair of hinge bases, each hinge bare having a base portion, and a pair of upstanding posts;

a seat ring, seat cover, and two pairs of hinge leafs wherein all leafs have essentially the same shape, each hinge leaf further comprising:

a plate-like attachment portion having spaced apart through openings for connecting to a toilet seat cover or lid on one end and a raised portion having a generally flat surface at an end opposite the one end, and a single pivot arm portion having a through opening and extending at a right angle from the plate-like attachment portion and being adjacent the raised portion; and connecting a first pair of hinge leafs to each seat cover and a pair of hinge leafs to each seat ring, and connecting the opposing single pivot arm portions of adjacent leafs to a respective hinge base using a connecting pin, so that the opposing pivot arm portions of adjacent leafs are positioned between the upstanding posts of a respective hinge base.

7. The method of claim 6, wherein the plate-like attachment portion is trapezoidal in shape, with the wider end of the trapezoid corresponding the one end.

* * * * *